United States Patent [19]

Coverstone

[11] 4,294,003

[45] Oct. 13, 1981

[54] INSULATED RADIANT HEATING PANEL

[75] Inventor: Don A. Coverstone, Larwill, Ind.

[73] Assignee: Lyall Electric, Inc., Albion, Ind.

[21] Appl. No.: 103,190

[22] Filed: Dec. 13, 1979

[51] Int. Cl.[3] ..... H05B 3/00

[52] U.S. Cl. ..... 29/611; 29/613; 219/213; 219/345

[58] Field of Search ..... 29/611, 613; 219/200, 219/213, 320, 328, 345, 407, 414, 456, 499, 522, 523, 528, 529, 543, 545, 549, 448, 457, 20.4; 264/272, 345, 528, 275, 320, 328

[56] References Cited

U.S. PATENT DOCUMENTS

| | | | |
|---|---|---|---|
| 3,041,441 | 6/1962 | Elbert et al. | 219/345 |
| 3,323,197 | 6/1967 | Millard | 264/272 |
| 3,657,516 | 4/1972 | Fujihara | 219/345 |
| 3,664,013 | 5/1972 | MacGuire | 219/345 |
| 3,678,248 | 7/1972 | Tricault et al. | 219/405 |
| 3,686,472 | 8/1972 | Harris | 219/345 |
| 3,697,728 | 10/1972 | Stirzenbecher | 219/345 |
| 3,721,800 | 3/1973 | Eisler | 219/345 |
| 3,737,624 | 6/1973 | Eilenberger | 219/345 |
| 3,974,359 | 8/1976 | Orcutt et al. | 219/544 |
| 4,031,353 | 6/1977 | Segura | 219/345 |

*Primary Examiner*—Leon Gilden

*Attorney, Agent, or Firm*—Roger M. Rickert

[57] ABSTRACT

A radiant heating device and a method of forming such a device are disclosed wherein a metal heat radiating plate has a first surface for forming a front surface of the heating panel with the surface opposite that first surface having an electrically insulated sheet heating element affixed thereto. The plate and heating element are embedded in a flowable material to cover the heating element and the plate edges about substantially the entire periphery of the plate while leaving the plate front surface substantially material free and that flowable material solidified to form an electrically and thermally insulating frame for supporting the plate and the heating element. External lead wires and an on-off switch for controlling the supply of electrical energy to the heating element are connected to the heating element prior to the embedding process with the switch positioned so as to extend through the insulating frame after solidification to be positioned in a frame border portion on the front surface of the heating panel for easy actuation by a user. The flowable material preferably forms a flame retardant frame when solidified.

9 Claims, 4 Drawing Figures

INSULATED RADIANT HEATING PANEL

BACKGROUND OF THE INVENTION

The present invention relates generally to heating devices, and more particularly, to a radiant heating panel and process of fabricating such a panel wherein the panel framework or housing and the panel rear surface insulation are formed in one piece by a single process.

Radiant heating panels have been manufactured in a number of different forms. In one form as marketed by the assignee of the present application, a generally rectangular heating panel of 2½ to 3 feet in width by perhaps as much as 3 to 4 feet in length and designed to either hang on a wall, much like a picture, or to be free-standing with a rear leg extending therefrom in a tripod fashion, has been constructed in much the same manner as one would construct a picture frame. In this known radiant heating panel, a metal border or frame confines a front sheet metal surface to the back of which is adhered a flat foil sheet which encapsulates an electrical heating element. Behind the foil heating sheet, insulation is positioned and finally a rear panel of a pressed fiberboard forms the back of the radiant heating panel. In operation, the front metal sheet becomes warm but not extremely hot and radiant heat emanates from this surface for warming persons within the room and near the heater. The insulating material between the heating element and the rear panel of the device keeps that rear panel and walls or other structures, against which the radiant heating panel might be positioned, relatively cool, thereby not only improving the efficiency of the radiant heating device but also minimizing the likelihood of heat damage or fire.

This known heating panel requires the sequential positioning of a multiplicity of parts in its manufacturing process with the resulting end product, while aptly suited to its intended use, being relatively expensive.

It would be highly desirable to retain all of the advantageous features of the above-described heating panel, while reducing the overall cost of manufacturing such a heating panel.

SUMMARY OF THE INVENTION

Among the several objects of the present invention may be noted the provision of a radiant heating device of substantially reduced manufacturing cost; the provision of a radiant heating panel fabricating technique wherein the forming of the frame or housing and the thermal insulating of the back surface are accomplished by the same operation; the provision of an economical and efficient radiant heating device; and the provision of a technique for forming an entirely electrically insulated heating panel which is simultaneously thermally insulated over all but the front radiating surface thereof. These as well as other objects and advantageous features of the present invention will be in part apparent and in part pointed out hereinafter.

In general, a radiant heating panel is formed by selecting a metal plate having a first relatively flat surface for forming a front heat radiating surface of the panel and affixing an electrically insulated sheet heating element to the surface of the metal plate opposite the first surface and thereafter molding an insulating frame about substantially the entire periphery of the plate while leaving nearly the entire front surface of the plate free of insulation. The molding process may include forming a border about the plate front surface, as well as forming insulating material over substantially all of the heating element as an insulating mass continuous with the border, leaving only the front surface interior insulation free. The connection of external lead wires to the heating element with, for example, an on-off switch, in series with one of those lead wires prior to the molding step, and the positioning of that on-off switch to pass through the border to be accessible from the front of the heating panel, facilitate the process.

Also in general and in one form of the invention, a radiant heating device has a front metallic heat radiating surface and a resistance heating element in the form of an electrically insulated relatively thin sheet with at least a pair of leads emanating therefrom and with the heating element positioned in good heat transfer relation with a substantial portion of the area of the heat radiating surface. A one piece molded insulating frame is formed over substantially the entirety of one sheet surface and extends to the front metallic surface to form a border thereabout. The resistive heating element may comprise a resistance wire array disposed between layers of electrical insulating material which in turn have the outwardly facing surfaces thereof sandwiched between layers of metal foil and the insulating frame may be formed from a polyurethane foam of the type which is sufficiently fire retardant to not support combustion in the absence of an external flame.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
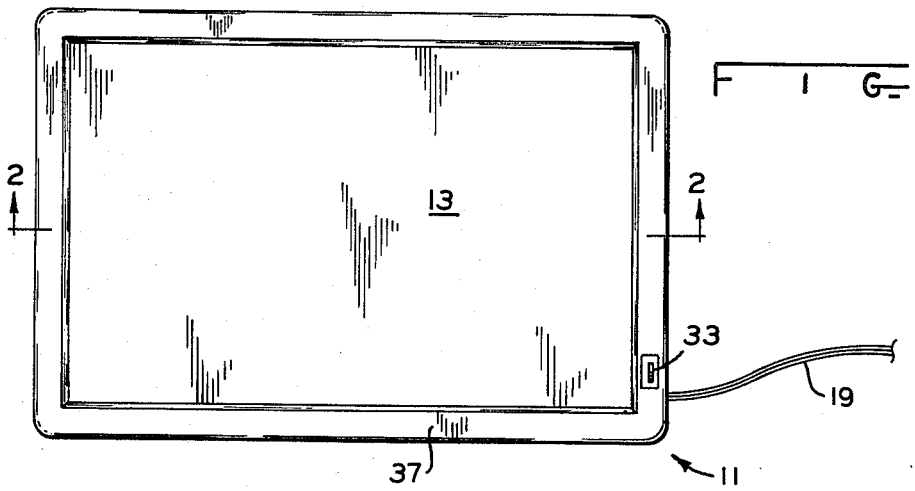
FIG. 1 is a view of the front heat radiating surface of a radiant heating device according to the present invention.
Figure 2:
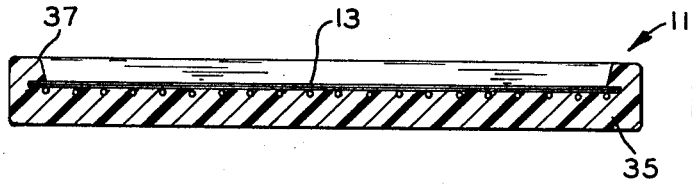
FIG. 2 is a view in cross-section along lines 2—2 of FIG. 1.
Figure 3:
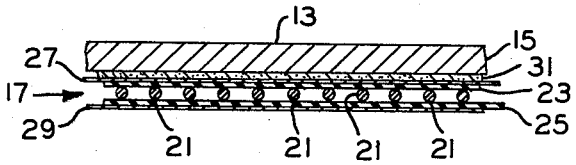
FIG. 3 is an enlarged view of a portion of FIG. 2, illustrating the adhering of an electrically insulated sheet heating element to the metal plate rear surface.

Referring first to FIGS. 1 through 3, a radiant heating device 11 has a front metallic heat radiating surface 13 in the form of one surface of a metal plate 15 and to the surface of plate 15 opposite surface 13 there is affixed a resistance heating element 17 in the form of an electrically insulated relatively thin sheet. This heating element 17 has a pair of lead wires 19 emanating therefrom and the heating element 17 is positioned in good heat transfer relation with a substantial portion of the area of the heat radiating surface. The heating element 17 is a resistive heating element and includes a resistance wire array 21 of resistance wire, for example in a serpentine pattern or in a matrix array, so that the individual conductors pass repeatedly across the sheet heating element to relatively uniformly heat the metal plate 15. The resistive wire array 21 is disposed between layers 23 and 25 of electrical insulating material which in turn have their outwardly facing surfaces sandwiched between layers of metal foil 27 and 29. The sheet heating element 17 may be afffixed to the plate 15 by a layer of adhesive material 31. An electrical switch 33 is placed in series with one of the external lead wires 19 to control the supply of electrical energy to the heating element.

Figure 4:
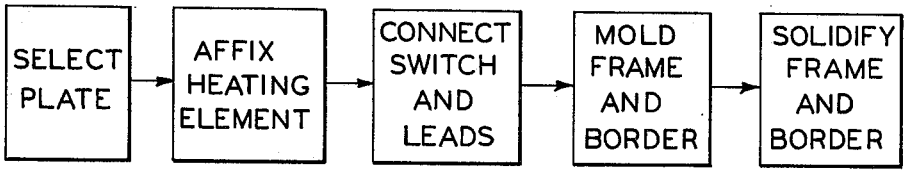
FIG. 4 is a functional block diagram of a process for fabricating the radiant heating panel depicted in FIGS. 1 through 3.

A one piece molded insulating frame 35 surrounds the outer or back foil layer 29 and the edges of the plate and sheet heating element extending slightly to the front metallic surface to form a border 37 thereabout. This frame 35 is molded from a flowable polyurethane foam material of a type which is sufficiently flame retardant to not support combustion in the absence of an external flame. This foam material when solidified or cured is a good electrical and thermal insulator. With the polyurethane foam material selected and prepared in its flowable state, the sequence of operations in assembling the present radiant heating panel is as depicted in FIG. 4.

A metal heat radiating plate 15 is selected with front surface 13 to be the front surface of the heating panel and an electrically insulated sheet heating element 17 is affixed to the surface of plate 15 opposite surface 13, for example by adhesive material 31. Switch 33 and external lead wires 19, if not already connected to the heating element 17, are next connected thereto, and the metal plate and adhering heating element are embedded in the flowable material to cover the heating element as well as the plate edges about substantially the entire periphery of the plate while leaving the plate front surface 13 substantially material free. During this embedding process, the switch 33 is positioned so as to extend through the border 37 in a user actuable manner and the flowable material is solidified to form the electrically and thermally insulating frame for supporting the plate and heating element.

From the foregoing it is now apparent that a novel method of manufacturing radiant heating panels, as well as a novel radiant heating device, have been disclosed meeting the objects and advantageous features set out hereinbefore, as well as others, and that modifications as to the precise configurations, shapes and details may be made by those having ordinary skill in the art without departing from the spirit of the invention or the scope thereof as set out by the claims which follow.

What is claimed is:

1. The method of forming a radiant heating panel comprising the steps of:

selecting a relatively flat metal heat-radiating plate having a first generally planar surface for forming a front surface of the panel;

adhering an electrically insulated sheet heating element to a second generally planar surface of the metal plate opposite the first surface;

embedding the metal plate and adhering heating element in a flowable material to cover the heating element and the plate edges about substantially the entire periphery of the plate while leaving the plate front surface substantially material free; and solidifying the flowable material to form an electrically and thermally insulating frame for supporting the plate and heating element.

2. The method of claim 1 further comprising the step of connecting external lead wires to the heating element prior to the step of embedding.

3. The method of claim 2 wherein the step of connecting includes connecting a switch in circuit with the lead wires for controlling the supply of electrical energy to the heating element, the step of embedding including positioning the switch so as to extend through the insulating frame surface in a user actuable manner after solidification of the flowable material.

4. The method of claim 1 wherein the step of embedding includes selecting a flowable material which upon solidification forms a flame retardant heating panel frame.

5. The method of forming a radiant heating panel comprising the steps of:

selecting a metal plate having a first relatively flat surface for forming a front surface of the panel;

affixing an electrically insulated sheet heating element to a second relatively flat surface of the metal plate opposite the first surface; and molding an insulating frame about substantially the entire periphery of the plate and a small border portion of the front surface, while leaving nearly the entire front surface of the plate free of insulation.

6. The method of claim 5 wherein the step of molding includes forming a border about the plate front surface while leaving the front surface interior insulation free.

7. The method of claim 6 wherein the step of molding includes forming insulating material over substantially all of the heating element as an insulating mass continuous with the border.

8. The method of claim 6 further comprising the step of connecting external lead wires to the heating element with an on-off switch in series with one of the lead wires prior to the step of molding, the step of molding including locating the on-off switch to pass through the border so as to be accessible from the front of the heating panel.

9. The method of claim 5 wherein the step of molding includes selecting a flame retardant material and employing the selected material to form the insulating frame.

* * * * *